US005174659A

United States Patent [19]

Laske

[11] Patent Number: 5,174,659

[45] Date of Patent: Dec. 29, 1992

[54] RECLOSABLE FLEXIBLE BAG

[75] Inventor: Louis L. Laske, Libertyville, Ill.

[73] Assignee: Vonco Products, Inc., Lake Villa, Ill.

[21] Appl. No.: 719,190

[22] Filed: Jun. 21, 1991

[51] Int. Cl.[5] ..... B65D 33/34

[52] U.S. Cl. ..... 383/207; 383/5; 383/66; 383/89

[58] Field of Search ..... 383/5, 66, 78, 88, 89, 383/200, 207, 83

[56] References Cited

U.S. PATENT DOCUMENTS

| | | | |
|---|---|---|---|
| 2,991,001 | 7/1961 | Hughes . | |
| 3,184,149 | 5/1965 | Repko | 383/203 |
| 3,276,669 | 10/1966 | Vilutis | 383/204 |
| 4,509,196 | 4/1985 | Sak et al. | 383/66 X |
| 4,510,621 | 4/1985 | Sak et al. . | |
| 4,709,399 | 11/1987 | Sanders | 383/66 |
| 4,759,642 | 7/1988 | Van Erden et al. . | |
| 4,759,643 | 7/1988 | Canno . | |
| 4,785,940 | 11/1988 | Wilson . | |
| 4,786,190 | 11/1988 | Van Erden et al. . | |
| 4,832,505 | 5/1989 | Ausnit et al. . | |
| 4,925,316 | 5/1990 | Van Erden et al. . | |
| 4,927,271 | 5/1990 | Branson . | |
| 5,056,930 | 10/1991 | Mestetsky | 383/66 X |

FOREIGN PATENT DOCUMENTS

| | | | |
|---|---|---|---|
| 1436489 | 5/1976 | United Kingdom | 383/88 |
| 8912582 | 12/1989 | World Int. Prop. O. | 383/5 |

*Primary Examiner*—Allan N. Shoap
*Assistant Examiner*—Jes F. Pascua
*Attorney, Agent, or Firm*—Speckman & Pauley

[57] ABSTRACT

An initially closed openable and reclosable closure for flexible bags, the closure having a tearable line of weakening defining an openable elongated slit in a flexible film of one face of the flexible bag and pressure sensitive adhesive provided on the exterior of the one face of the flexible bag on opposite sides of the openable elongated slit whereby the tearable line of weakening may be ruptured thereby opening the elongated slit and providing access to the interior of the bag. The opened elongated slit may be reclosed by folding the bag to bring the adhesive into confronting relation with itself on opposite sides of the elongated slit to form an adhesive-to-adhesive closure thereby closing the elongated slit. Reclosable flexible bags of this type reclosed in a tamper evident manner are especially useful in medical and health care fields.

16 Claims, 1 Drawing Sheet

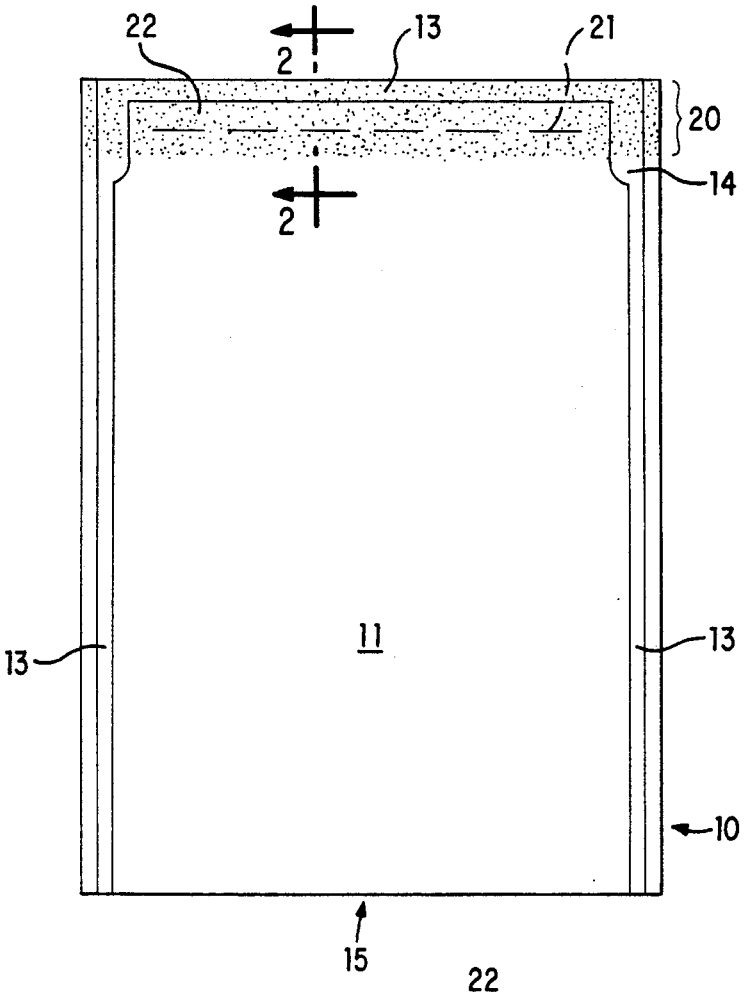
FIG. 1
FIG. 4A
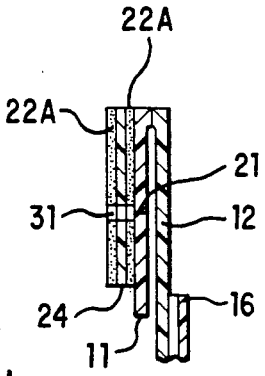
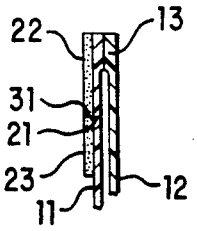
FIG. 2
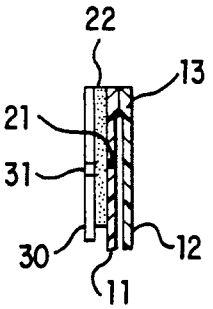
FIG. 4
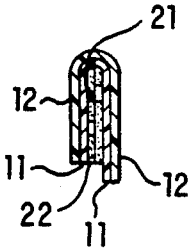
FIG. 3
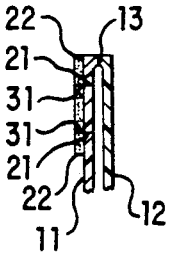
FIG. 6
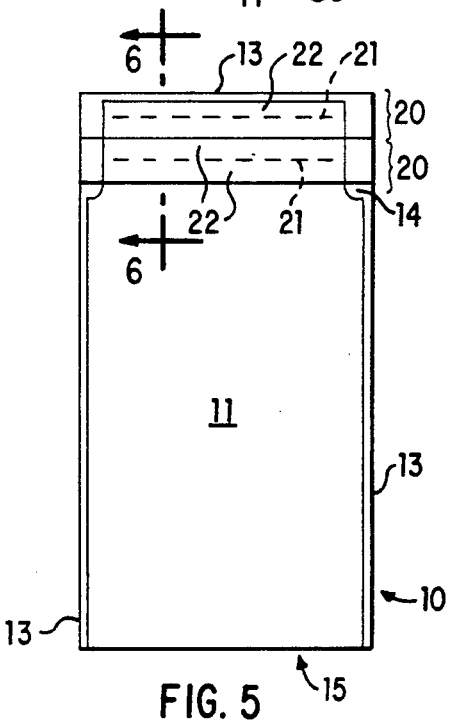
FIG. 5

RECLOSABLE FLEXIBLE BAG

BACKGROUND OF THE INVENTION

1. Field of the Invention

This invention relates to an initially closed openable and reclosable closure for a flexible bag. Flexible bags having a closure of this invention may be initially filled through an unsealed edge region between a front and rear film, sealed in the area of the filling to provide an initially closed bag containing desired contents which later can be opened at a different region for removal of the contents followed by insertion of the same or different contents and then reclosed at the later opening, preferably resealed in a tamper evident manner only with the use of the hands and without the need for any tools or appliances. Reclosable flexible bags of this type are especially useful for providing medical test materials which may be removed from a closed bag by the user, used as desired and returned to the same bag and reclosed in a tamper evident manner for return to a medical laboratory for analysis.

2. Description of Related Art

Various types of closures and seals for flexible bags have been known over the years of use of such bags. A multitude of efforts have been made to provide reclosable and/or resealable flexible bags for a wide variety of specialized uses. In recent years tamper evident seals have become important, particularly in food and health care environments.

Exemplary of adhesive sealing of open tops of containers after filling with desired contents are: U.S. Pat. No. 4,759,643 teaches a self-sealing, non-resealable envelope wherein an adhesive area at the top portion of a longer flap seals to both sides of the upper portion of a shorter flap when the longer flap is folded over the top of the shorter flap; U.S. Pat. No. 4,785,940 teaches a pressure sensitive adhesive closure strip on the front surface of a back panel of a flexible bag which when folded over a shorter front panel adheres to the front surface of the shorter front panel; and U.S. Pat. No. 4,510,621 teaches an adhesive to adhesive sealing material on the exterior surface of one plastic film web on opposite sides of a transversly extending access opening slit in that web of a pouch, the opening being sealed by folding the pouch over upon itself along the opening slit after placement of contents into the pouch so as to bring the adhesive into confronting relation with itself to form the adhesive-to-adhesive seal.

Likewise, a number of efforts have been made to provide reclosable flexible bags which also provide tamper evident initial opening seals: U.S. Pat. Nos. 4,786,190 and 4,925,316 teach a reclosable peal seal and a reclosable zipper seal, respectively, exterior to a non-reclosable tamper evident seal; U.S. Pat. No. 4,759,642 teaches a zipper-type reclosable seal exterior to a peal seal in a bag with corner chamfers; U.S. Pat. No. 2,991,001 teaches a resealable container with a permanent seal exterior to a pressure sensitive resealable seal, necessitating removal of a tear strip to expose the pressure sensitive adhesive; U.S. Pat. No. 4,927,271 teaches a zipper-type reclosable means having a sealed tamper evident hood enveloping the opening area, opening being first achieved by removal of the top portion of the hood; and U.S. Pat. No. 4,832,505 teaches a zipper-type reclosable means having the sides of a bag extending above the reclosable means and sealed, necessitating removal of the extending sides to obtain first access to the interior and the reclosable means.

SUMMARY OF THE INVENTION

It is an object of this invention to provide an initially close openable and reclosable closure for a flexible bag.

It is another object of this invention to provide a flexible bag which may be initially filled through an unsealed edge region between its front and rear panels, sealed in the area of filling to provide an initially closed bag containing desired contents which can later be opened at a different region for removal of the contents followed by replacement of contents into the bag which can be reclosed at the later opening.

It is still another object of this invention to provide a initially closed openable and reclosable closure for a flexible bag which may be reclosed in a tamper evident manner.

These and other objects and advantages of this invention, which will become apparent upon reading the more detailed disclosure, are achieved by a closure having a tearable line of weakening defining an openable elongated slit in the flexible film of one face of the flexible bag and pressure sensitive closure means provided on the exterior of the flexible film of the one face on opposite sides of the openable elongated slit whereby the tearable line of weakening may be ruptured thereby opening the elongated slit and providing access to the interior of the bag. The opened elongated slit may be reclosed by folding the bag to bring the adhesive closure means into confronting relation with itself on opposite sides of the elongated slit to form an adhesive-to-adhesive closure for closing the elongated slit. The tearable line of weakening may be a solid and tearable line of weakening or perforations, depending upon the use of the bag. The closure means may comprise a layer of adhesive applied to the flexible film or may comprise a laminate adhesive on a carrier structure and applied on opposite sides of the elongated slit. When the adhesive of the adhesive closure has a greater adhesive-to-adhesive strength than at least one of the face of the flexible bag and a carrier structure of the adhesive closure, a tamper evident seal is provided.

BRIEF DESCRIPTION OF THE DRAWING

The above objects and advantages of this invention will become further apparent from reading of the detaied description of preferred embodiments in reference to the drawing wherein:

FIG. 1 is a front view of one embodiment of a reslosable bag accoding to this invention;

FIG. 2 is an enlarged sectional view through section 2—2 shown in FIG. 1;

FIG. 3 is a sectional view of the same section shown in FIG. 2 in closed position;

FIG. 4 is a sectional view similar to FIG. 2 showing another embodiment of a reclosable closure according to this invention;

FIG. 4A is a sectional view similar to FIG. 4 showing yet another embodiment of a reclosable closure according to this invention;

FIG. 5 is a front view of a reclosable bag of this invention having multiple reclosable closures; and FIG. 6 is a sectional view through section 6—6 shown in FIG. 5.

DESCRIPTION OF PREFERRED EMBODIMENTS

Referring to FIG. 1, reclosable flexible bag 10 is shown to be generally rectangular with front web 11 joined to generally coextensive rear web 12 along marginal edges by edge seals 13 except in an open initial filling region 15. Edge seals 13 may be inward from the outer edge and may be of any desired width or shape, or may be narrow bead seals or cut-off heat seals as commonly used on polyolefin bags. Flexible bags are well known in the art and any known method of manufacture, such as joining two separate webs or folding a single web over upon itself, is satisfactory to form the basic flexible bag structure of this invention. Any flexible sheet material is suitable, such as plastic films, laminates, spun-bonded plastic fibers, and paper or paperlike materials, dependent upon the particular use. In many preferred embodiments of this invention it is preferred to use heat sealable polyolefin films, such as polyethylene and polypropylene which can be heat sealed by well known methods. Although shown in FIG. 1 as rectangular, flexible bag 10 may be any desired shape.

An initially closed openable and reclosable closure 20 is located inwardly from one marginal edge of flexible bag 10. Although shown in FIG. 1 as being opposite initial filling region 15, initially closed openable and reclosable closure 20 may by spaced inwardly from any marginal edge of bag 10 as long as flexible bag 10 may be initially filled through initial filling region 15 which may then be sealed without interfering with openable and reclosable closure 20. Multiple initially closed openable and reclosable closures 20 which may be independently opened and closed may be provided adjacent each other, as shown in FIGS. 5 and 6, or in different locations, as desired, on the front and/or rear web of the bag. Initially closed openable and reclosable closure 20 has a tearable line of weakening 21 which defines an openable elongated slit in the flexible film of front web 11. For leakproof use, it is preferred that tearable line of weakening 21 is spaced inwardly from a sealed edge of the bag and that tearable line of weakening 21 terminates inwardly from opposite edge seals of the bag, as shown in FIG. 1. By the terminology "tearable line of weakening" is meant any suitable weakening of the flexible web so that it may be ruptured along the line of weakening by pulling on opposite sides by a person's hands to form an open elongated slit through which contents may be removed and replaced. There may be a solid but tearable line of weakening in the web to provide a sealed relation between the exterior and interior of the flexible bag at the initially closed openable and reclosable closure or there may be perforations, dependent upon the desired use for the flexible bag.

Pressure sensitive adhesive closure means 22 is provided on the exterior of flexible web 11 on opposite sides of openable and reclosable elongated slit 21. Pressure sensitive adhesive closure means may be any type of pressure sensitive adhesive sealing means known to the art. Suitable adhesive may be applied to the exterior of the flexible web on opposite sides of openable and reclosable elongated slit 21 in the form of an adhesive applied directly to the flexible web or, preferably, a laminate adhesive means as well known in the art may be used. Laminate adhesive means having adhesive on both sides of a flat flexible carrier structure are particularly suitable for use in the closure of this invention. Two laminate adhesive strips may be used with one applied to each side of openable and reclosable elongated slit 21 or a single laminate adhesive means which extends over opposite sides of openable and reclosable elongated slit 21 may be used. In the latter case, carrier structure of the adhesive laminate must also be tearable along the openable elongated slit defined by tearable line of weakening 21. This may be achieved by weakening the laminated adhesive means in place in the same operation as weakening the flexible web. An adhesive may be chosen for the closure means which has an adhesive-to-adhesive bond strength of less than the tear strength of the flexible web forming the bag to enable further opening and closing of the bag beyond the first closing of the bag at the initially closed openable and reclosable closure, when desired. In preferred embodiments, the adhesive-to-adhesive bond strength of the adhesive is greater than at least one of the face or web of the flexible bag and a carrier structure of the adhesive closure means thereby providing a tamper evident seal by tearing upon opening of either the web flim of the bag or the carrier structure of the adhesive means, each readily visible upon inspection. For leakproof use, it is preferred that adhesive closure means 22 extend beyond the ends of tearable line of weakening 21 to ensure tight sealing of the opening upon reclosure, while for uses in which liquid or gas leakage is not important, tearable line of weakening 21 may extend to the edges of adhesive closure means 22.

FIG. 2 is an enlarged sectional view through closure means 22 showing its positioning on the exterior of front web 11 on opposite sides of tearable line of weakening 21 with adhesive face 23 directed outwardly. FIG. 3 is an enlarged sectional view of the same closure means of FIG. 2 shown in a reclosed condition. It is seen that to reclose the initially closed openable and reclosable closure, the flexible bag is folded to bring adhesive closure means 22 into confronting relation with itself on opposite sides of elongated slit 21 to form an adhesive-to-adhesive closure for closing elongated slit 21 by pressing folded over portions of adhesive face 23 together.

FIG. 4 shows another embodiment of a closure of this invention having removable protective means 30 covering adhesive means 22. Removable protective means 30 provides protection for the adhesive and permits easy handling of the flexible bag. Removable protective means 30 must have an open or an openable slot 31 indexed with tearable line of weakening 21 in the web or film forming the flexible bag. This is necessary so that the initially closed closure can be opened with retention of removable protective means 30 in place until reclosing of reclosable closure 20 is desired. Such an open slot may be provided by having removable protective means 30 in two separate spaced strips or a slot 31 cut in a single removable protective means 30. An openable slot 31 may be provided by a tearable line of weakening which may be ruptured when opening is desired. In preferred embodiments, a laminate adhesive closure means having removable protective means 30 in place adjacent one face may be adhered to the desired location on the flexible web or film and either a solid line of weakening or perforations effected in the flexible web, the carrier structure of the adhesive laminate, and the removable protective sheet in a single operation to provide automatic indexing of the opening position.

FIG. 4A shows another embodiment of a closure according to this invention which is similar to the embodiment shown in FIG. 4 except for the laminate adhesive means and third web 16 shown in FIG. 4A. The laminate adhesive means preferably comprises a first layer of adhesive 22A on one side of flat flexible carrier structure 24 and a second layer of adhesive 22A on the opposite side of flexible carrier structure 24. Flexible carrier structure 24 preferably has a tearable line of weakening indexed with the tearable line of weakening of the flexible film of front web 11. Third web 16 is preferably sealed at three edges to either front web 11 or rear web 12 and has a fourth edge open and spaced inwardly from the closure to permit insertion of contents into an open volume formed between third web 16 and either front web 11 or rear web 12.

By use of the above described initially closed openable and reclosable closure, a flexible bag is provided having first and second generally coextensive webs joined together except in an open initial filling region. The initially closed openable and reclosable closure may be located inwardly from any of the marginal edges of the flexible bag. Thus, the initially closed openable and reclosable closure may be located inwardly from a side adjacent, opposite, or the same side as the open initial filling region. This permits a flexible bag which is to be opened and reclosed in its top portion to be initially loaded with initial contents from the bottom, side or top. After initial loading with desired contents, the marginal edges in the initial filling region may be closed providing a closed flexible bag having initial contents within. The bag with the initial contents may be fully liquid or gas tight when the reclosable closure has a solid and tearable line of weakening and the marginal edges are provided with liquid or gas tight seals, such as heat seals, as known in the art. Such a flexible bag is also tamper evident upon its first opening and also upon its second opening using the initially closed openable and resclosable closure of this invention. Bags having the multiple initially closed openable and reclosable closures having tamper evident qualities may be used for multiple withdrawal and insertion of contents and reclosure in a tamper evident fashion providing a sure chain of entry and reclosure documentation, such as is desired for criminal or legal evidence.

To open for removal of the initial contents and to retain the reclosable closure, the tearable line of weakening in the web or film of the flexible bag is ruptured by pulling the tearable line of weakening apart with a hand on each side of the tearable line of weakening thereby opening the elongated slit and providing access to the interior of the bag for removal of the initial contents. Any contents may be placed in the flexible bag through the open slit and the reclosable closure closed by folding the flexible bag over itself to bring the adhesive on the face of the asdhesive closure into confronting relation with itself on opposite sides of the elongated slit to form an adhesive-to-adhesive closure for the flexible bag. As pointed out above, the closure may be readily tamper evident.

The initially closed openable and reclosable closures in accordance with this invention are particularly useful for providing tamper evident flexible bags into which initial contents may be sealed and later the bags may be opened at a second location, have the initial contents removed, the same or different contents placed in the bag through the opening at the second location, and reclosed, again in a tamper evident manner. Such initially closed openable and reclosable closures are useful for a wide variety of purposes, particularly in the medical and health care fields. Flexible bags incorporating closures of this invention may be modified in many ways without departing from the invention. For example, one or more additional webs may partially overlay at least one side of the bag to provide at least one additional volume for enclosing additional or identifying material which does not have to be subject to intial enclosure, removal, and later enclosure as provided by the initially closed openable and reclosable closure of this invention.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of the invention.

I claim:

1. An initially closed openable and reclosable closure for a flexible bag comprising: a tearable line of weakening defining an openable elongated slit in a flexible film comprising one face of said flexible bag and pressure sensitive adhesive closure means provided on the exterior of said one face of said flexible bag on opposite sides of said openable elongated slit whereby said tearable line of weakening may be ruptured thereby opening said openable elongated slit and providing access to the interior of said bag and the opened elongated slit may be reclosed by folding the bag to bring said adhesive closure means into confronting relation with itself on opposite sides of said openable elongated slit to form an adhesive-to-adhesive closure for closing said openable elongated slit;

removable protective means covering said adhesive closure means and having one of an open and an openable slot indexed with said tearable line of weakening of said flexible film whereby said tearable line of weakening of said flim may be ruptured thereby opening said openable elongated slit and providing access to the interior of said bag and the opened openable elongated slit may be reclosed by removing said protective means and folding the bag to bring said adhesive closure means into confronting relation with itself on opposite sides of said openable elongated slit to form an adhesive-to-adhesive closure for closing said openable elongated slit; and said openable slot comprising a tearable line of weakening defining said openable slot and indexed with said tearable line of weakening of said flexible film whereby both said tearable line of weakening of said film and said tearable line of weakening of said openable slot may be ruptured thereby opening said openable elongated slit and providing access to the interior of said bag and the opened openable elongated slit may be reclosed by removing said protective means and folding the bag to bring said adhesive closure means into confronting relation with itself on opposite sides of said elongated slit to form an adhesive-to-adhesive closure for closing said elongated slit.

2. A closure for a flexible bag in accordance with claim 1 wherein said tearable line of weakening of said flexible film comprises a solid and tearable line of weakening spaced inwardly from a sealed edge of said bag and terminates inwardly from opposite edge seals of said bag, said adhesive closure means extends beyond the ends of said openable elongated slit, and the adhesive of said adhesive closure means has a greater adhesive-to-adhesive strength than at least one of said one face of said flexible bag and a carrier structure of said adhesive closure means thereby providing a tamper evident seal.

3. A closure for a flexible bag in accordance with claim 1 wherein at least one of said tearable lines of weakening comprises a solid and tearable line of weakening.

4. A closure for a flexible bag in accordance with claim 1 wherein at least one of said tearable lines of weakening comprises perforations.

5. A closure for a flexible bag in accordance with claim 1 wherein said tearable line of weakening of said flexible film is spaced inwardly from a sealed edge of said bag and terminates inwardly from opposite edge seals of said bag.

6. A closure for a flexible bag in accordance with claim 1 wherein said adhesive closure means extends beyond the ends of said openable elongated slit.

7. A closure for a flexible bag in accordance with claim 1 wherein said adhesive closure means comprises a layer of adhesive applied to said flexible film on opposite sides of said elongated slit.

8. A closure for a flexible bag in accordance with claim 1 wherein said adhesive closure means comprises a laminate adhesive means having a first layer of adhesive on one side of a flat flexible carrier structure and a second layer of adhesive on the opposite side of said flat flexible carrier structure, said carrier structure having a tearable line of weakening indexed with said tearable line of weakening of said film.

9. A closure for a flexible bag in accordance with claim 1 wherein the adhesive of said adhesive closure means has a greater adhesive-to-adhesive strength than at least one of said one face of said flexible bag and a carrier structure of said adhesive closure means thereby providing a tamper evident seal.

10. A reclosable flexible bag comprising: first and second generally coextensive webs joined together along marginal edges except in an open initial filling region and having spaced inwardly from one of said marginal edges an initially closed openable and reclosable closure comprising a tearable line of weakening defining an openable elongated slit in one of said webs and pressure sensitive adhesive closure means provided on the exterior of said one web on opposite sides of said openable elongated slit whereby said tearable line of weakening may be ruptured thereby opening said openable elongated slit and providing access to the interior of said bag and the opened openable elongated slit may be reclosed by folding the bag to bring said adhesive closure means into confronting relation with itself on opposite sides of said openable elongated slit to form an adhesive-to-adhesive closure for closing said openable elongated slit;

removable protective means covering said adhesive closure means and having one of an open and an openable slot indexed with said tearable line of weakening of said web whereby said tearable line of weakening of said web may be ruptured thereby opening said openable elongated slit and providing access to the interior of said bag and the opened openable elongated slit may be reclosed by removing said protective means and folding the bag to bring said adhesive closure means into confronting relation with itself on opposite sides of said openable elongated slit to form an adhesive-to-adhesive closure for closing said openable elongated slit; and said openable slot comprising a tearable line of weakening defining said openable slot and indexed with said tearable line of weakening of said web whereby both said tearable line of weakening of said web and said second tearable line of weakening of said openable slot may be ruptured opening said openable elongated slit and providing access to the interior of said bag and the opened openable elongated slit may be reclosed by removing said protective means and folding the bag to bring said adhesive closure means into confronting relation with itself on opposite sides of said elongated slit to form an adhesive-to-adhesive closure for closing said elongated slit.

11. A reclosable flexible bag in accordance with claim 10 having multiple said initially closed openable and reclosable closures.

12. A reclosable flexible bag in accordance with claim 10 wherein said tearable line of weakening of said web comprises a solid and tearable line of weakening spaced inwardly from a sealed edge of said bag and terminates inwardly from opposite edge seals of said bag, said adhesive closure means extends beyond the ends of said openable elongated slit and the adhesive of said adhesive closure means has a greater adhesive-to-adhesive strength than at least one of said web of said flexible bag and a carrier structure of said adhesive closure means thereby providing a tamper evident seal.

13. A reclosable flexible bag in accordance with claim 10 generally rectangular in shape wherein said first and second webs are joined together along three marginal edges and have a fourth edge open to provide said open initial filling region, said tearable line of weakening of said web comprises a solid and tearable line of weakening spaced inwardly from one of said three marginal edges and terminates inwardly from opposite edge seals of said bag, said adhesive closure means extends beyond the ends of said openable elongated slit and the adhesive of said adhesive closure means has a greater adhesive-to-adhesive strength than at least one of said web of said flexible bag and a carrier structure of said adhesive closure means thereby providing a tamper evident seal.

14. A reclosable flexible bag in accordance with claim 13 wherein said closure additionally comprises removable protective means covering said adhesive closure means and having one of an open and an openable slot indexed with said tearable line of weakening of said web whereby said tearable line of weakening of said web may be ruptured thereby opening said openable elongated slit and providing access to the interior of said bag and the opened openable elongated slit may be reclosed by removing said protective means and folding the bag to bring said adhesive closure means into confronting relation with itself on opposite sides of said openable elongated slit to form an adhesive-to-adhesive closure for closing said openable elongated slit.

15. A reclosable flexible bag in accordance with claim 14 additionally comprising a third web exterior to and sealed at three edges to one of said first and second webs and having a fourth edge open and spaced inwardly from said closure to permit insertion of contents into an open volume between said third web and said one of said first and second webs.

16. A reclosable flexible bag in accordance with claim 13 having multiple said initially closed openable and reclosable closures.

* * * * *